United States Patent [19]

Nix et al.

[11] Patent Number: 4,932,348

[45] Date of Patent: Jun. 12, 1990

[54] REMOTE CONTROL VALVE

[76] Inventors: Charles D. Nix, 1578 Slaughter Rd., Madison, Ala. 35758; Johnny P. Baker, 782 Burwell Rd., Harvest, Ala. 35749; William F. Huntley, 206 Wellington Rd., Athens, Ala. 35758

[21] Appl. No.: 348,879

[22] Filed: May 8, 1989

[51] Int. Cl.[5] ..... B63B 13/00

[52] U.S. Cl. ..... 114/183 R; 251/294; 251/312

[58] Field of Search ..... 114/183 R, 184, 185, 114/197, 198, 255; 251/294, 309, 312; 43/54, 1, 55–57

[56] References Cited

U.S. PATENT DOCUMENTS

| | | | |
|---|---|---|---|
| 1,278,882 | 9/1918 | Donnell | 114/198 |
| 2,730,862 | 1/1956 | Mitchell | 114/185 |
| 2,909,144 | 10/1959 | Baldwin | 114/185 |
| 2,997,975 | 8/1961 | Mueller | 114/183 R |
| 3,217,685 | 11/1965 | Mueller | 114/197 |
| 3,287,625 | 12/1966 | Grubb | 114/183 R |
| 3,565,031 | 2/1971 | DePersia | 114/185 |
| 3,757,726 | 9/1973 | Mueller | 114/183 R |
| 4,074,651 | 2/1978 | Arouser | 114/183 R |
| 4,198,918 | 4/1986 | Patriarca | 114/183 R |

*Primary Examiner*—Sherman D. Basinger

*Assistant Examiner*—Clifford T. Bartz

*Attorney, Agent, or Firm*—John C. Garvin, Jr.

[57] ABSTRACT

This invention relates to a remotely operated valve for closing and opening a conduit in communication with the interior of a boat to preclude water from entering or leaving the boat except when desired by the operator by the boat. The valve has application either as a means for keeping fresh water in the live well of the boat or as a means for bailing unwanted water from the interior of the boat. The valve has a main housing including a tapered bore and openings in communication with an interior water retaining portion of the boat and the exterior of the boat. A spring-urged tapered valve element having a passageway therein is mounted within the tapered bore of the main housing and is rotatable between first and second positions to bring the passageway of the valve element into and out of alignment with the openings in the main housing. The invention further includes means for remotely operating the valve to cause the rotation of the valve element between its first and second positions to allow water to flow in and/or out of the interior water retaining portion of the boat at the discretion of the operator of the boat as well as means for indicating to the operator whether the valve is in an opened or closed position.

19 Claims, 4 Drawing Sheets

REMOTE CONTROL VALVE

TECHNICAL FIELD

This invention relates to a valve and more particularly to a valve adapted to be remotely controlled for closing and opening a conduit in communication with the interior of a boat to preclude water from entering or leaving the boat except when desired by the operator of the boat. The valve of the instant invention has application as a means for keeping fresh water in the live well of a boat and as a means for bailing water from the boat. When used a valve for keeping fresh water in the live well of a boat to keep fish housed in the live well alive, the valve is opened when the boat is not moving or is moving very slow, and is closed when the boat is moving, particularly at a realtively fast rate. When used as a valve for bailing water from a boat, the valve is closed except when it is desired to bail water from the boat.

BACKGROUND OF THE INVENTION

The live well in a boat is used to hold water for placing fish which are caught to keep the fish alive. When the water in the live well is changed, or at least partially changed, fairly often, fresh water is maintained in the live well, thus allowing the fish to stay alive for a much longer period of time. Devices disposed within, or at the end of, a conduit in communication with both the live well and the water outside the boat to permit water to drain from and to the live well have been in use for many years. Without such a device, the water in the live well would be siphoned from the live well while the boat is moving, thus causing the fish housed therein to die in a relatively short period of time. Prior devices have included plugs made of rubber or other suitable material which are inserted and removed from one end of the conduit and valves disposed within or outside the conduit. By removing the plug or actuating the valve, water is permitted to drain in and/or out of the live well. The use of a plug had the disadvantage that a person must place his hand and at least a portion of his arm into the water to insert or remove the plug. Prior art valves, capable of being remotely operated, include conventional heater valves having a steel valve body therein that would rust and become inoperative after a relative short period of time and allow water from the live well to discharge into the hull of the boat. Prior art valves, capable of being remotely operated, have also included valves having structure similar to that of the conventional heater valve, but containing a plastic ball, which valves were glued and screwed together. These type of prior art valves proved to be less than ideal in that such valves had a tendency to leak after a short period of time.

Boats normally have a conduit in the back wall of its hull to drain water that has gotten into the interior of the boat. Devices disposed within, or at the end of, the conduit in communication with the interior of the boat for permitting water to drain or be siphoned from the interior of the boat have been in use for many years. Without such a device, water would drain into the boat and perhaps fill the boat while the boat was not moving in the water. Prior art devices have also included plugs made of rubber or other suitable material which are inserted and removed from one end of the conduit and valves disposed within the conduit. By removing the plug or actuating the valve, water is permitted to drain out of the interior of the boat. The use of the plug had the disadvantage that a person must place his hand and at least a part of his arm into the water to remove or insert the plug when the boat was moored in water. Prior art valves used for bailing purposes, capable of being remotely operated, also included conventional heater and other types of valves having a steel valve ball therein which would rust and become inoperative after a relatively short period of time and allow water from outside the boat to enter into the interior of the boat.

The instant invention relates to a remotely operated valve for mounting on or adjacent the back wall (transom) of a boat hull, either outside or inside the boat, which overcomes the numerous disadvantages of the prior art plugs and valves used for both bailing purposes and for keeping fresh water in the live well of a boat.

It is an object of the present invention to provide a new and improved valve which is operable to establish comunication and block off communication between the interior and exterior of a boat.

It is a further object of this invention to provide a new and improved valve to permit water to flow into or out of the interior of a boat.

It is still a further object of the present invention to provide a new and improved valve which can be remotely operated to permit water to flow into or out of the interior of a boat to either prolong the lives of fish housed in a live well of the boat or to siphon or drain water from the interior of the boat.

Other aspects, objects, and the several advantages of this invention will become apparent to those skilled in the art to which this invention pertains from a study of the preferred embodiments as set forth in the disclosure, the drawings, and the appended claims.

BRIEF DESCRIPTION OF THE INVENTION

According to the invention, there is provided a valve for controlling the flow of water into and out of a boat. The valve has a main housing including a tapered bore and openings in communication with the interior and exterior of a boat. A spring-urged tapered valve element having openings therein is rotatable between first and second positions within the tapered bore of the main housing to bring the openings in the valve element into and out of alignment with the openings in the main housing. The invention further includes means for remotely operating the valve to cause the rotation of the valve element between its first and second positions to allow water to flow out of the interior of a boat or into the interior of the boat at the discretion of the operator of the boat. The valve of the present invention in adaptable to be mounted either in communication with the live well of a boat to keep fish alive for extended periods of time or for use as a bailer for the boat. When used in communication with the live well of a boat, the operator would bring the openings in the main housing and valve element into alignment when the boat is stationary, or relatively stationary, in the water, and rotate the valve body to bring the openings out of alignment when the boat is moving, particularly at a relatively fast speed. When used as a bailer for a boat, the operator of the boat would bring the openings in the main housing and valve element into alignment only when the boat is moving and water is being bailed from the boat or when the boat is out of the water.

DETAILED DESCRIPTION OF THE INVENTION

The preferred embodiment of the remotely operated valve is capable of being used either as a means for keeping fish alive in a live well of a boat for an extended period of time or as a bailer for a boat. The basic structure of the valve is the same for both uses, the principal differences relate to the possible substitution of a simple opening or port in the main housing for one longitudinal tube and to the specific section of the boat which communicates with the simple opening or port of the main housing. The valve for either use is adaptable to be mounted either inside or outside of the boat.

Figure 1:
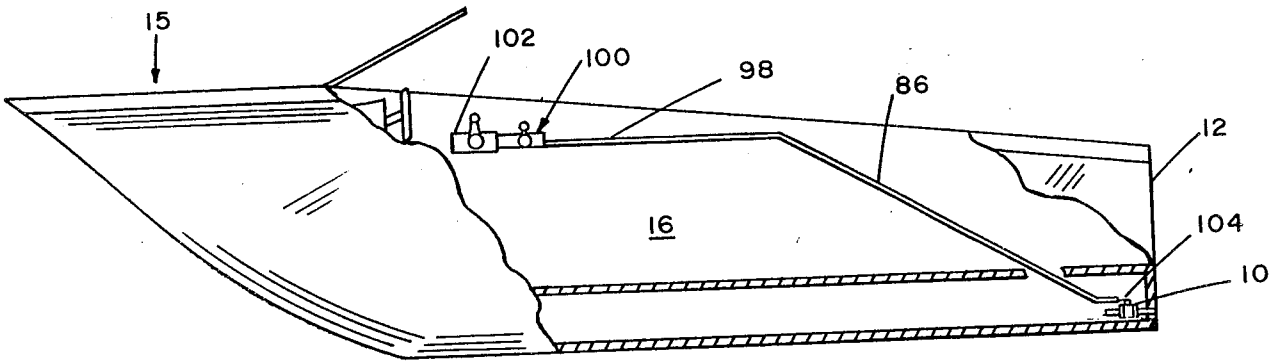
FIG. 1 is an elevational view of a boat having the control valve system of the present invention mounted in the interior of the boat.
Figure 2:
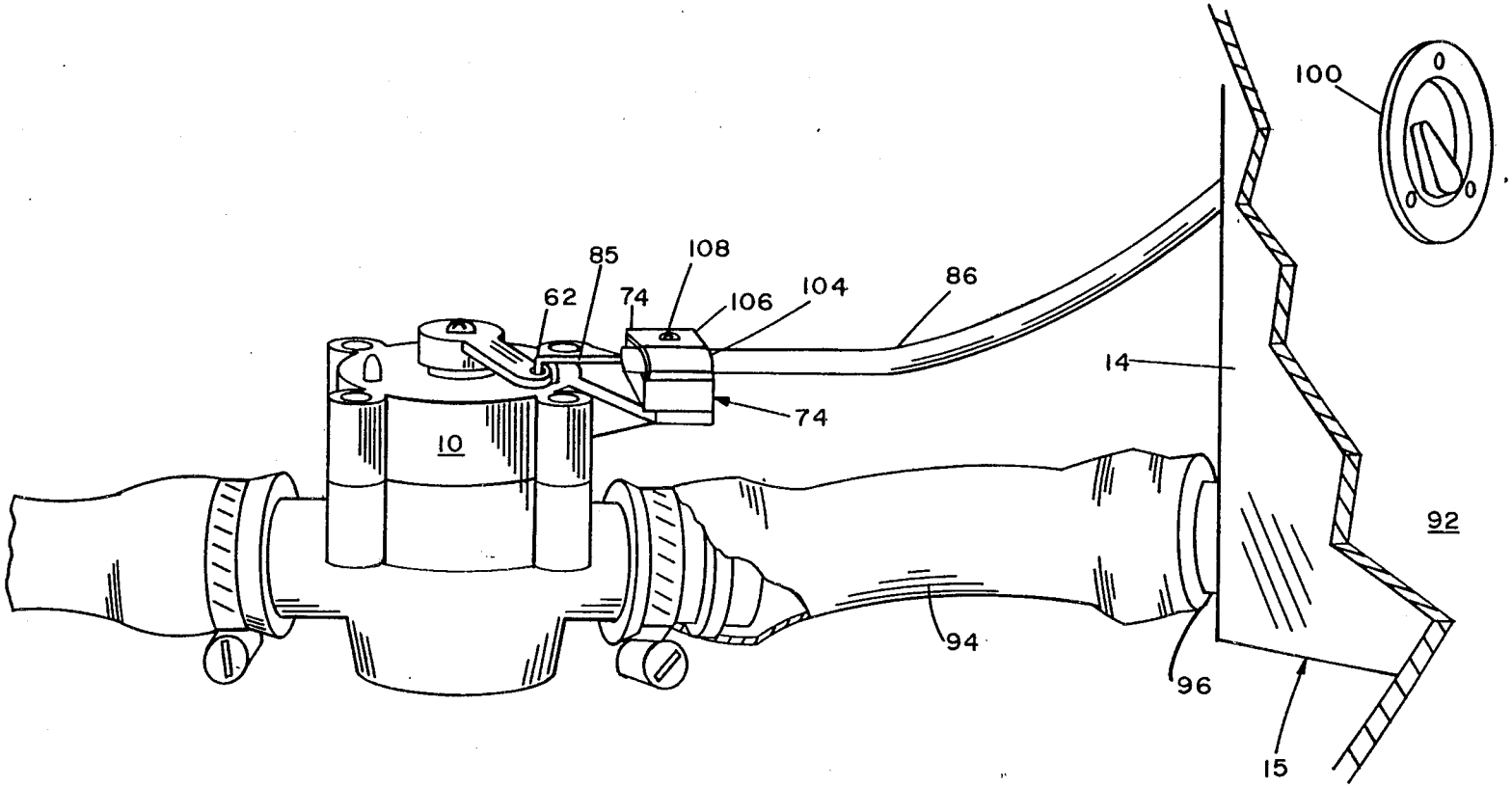
FIG. 2 is a partial elevational view of a boat having the control valve system of the present invention mounted exteriorily of the boat.
Figure 4:
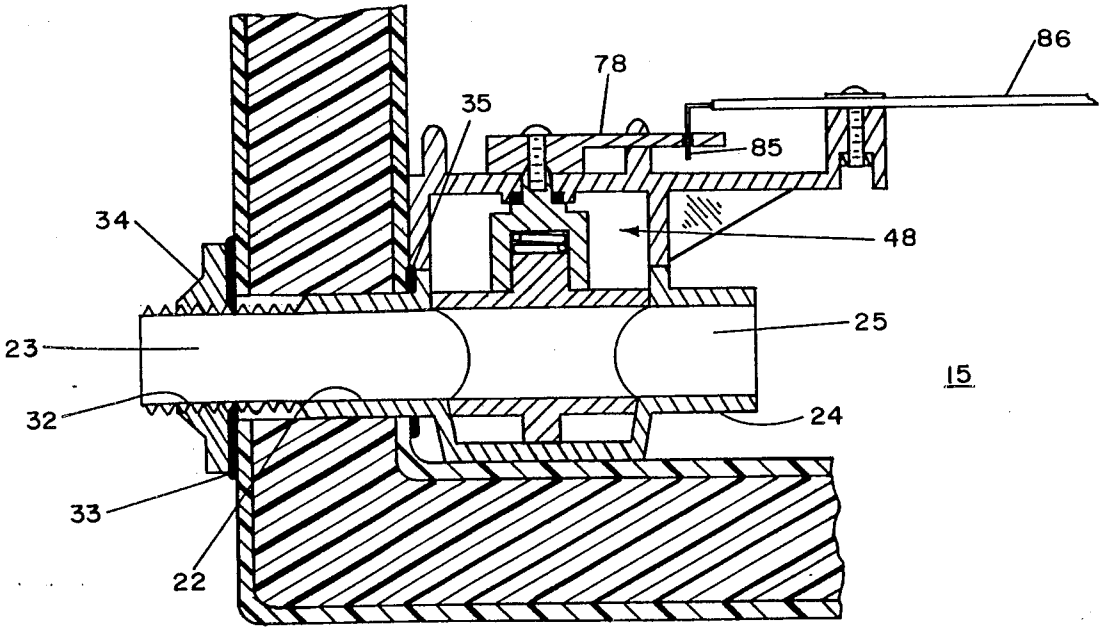
FIG. 4 is a sectional view through the control valve system of the present invention mounted in the interior of the boat.

FIGS. 1 and 4 illustrate, by way of example, the mounting of the valve 10 of the present invention in the interior of a boat; whereas, FIG. 2 illustrates, by way of example, the mounting of the valve 10 of the present invention on the exterior of the boat. For illustrative purposes, FIGS. 1 and 4 depict the valve 10 as used for bailing purposes; whereas, FIG. 2 depicts the valve 10 as used for prolonging the lives of fish housed within the live well 92 of a boat.

Figure 3:
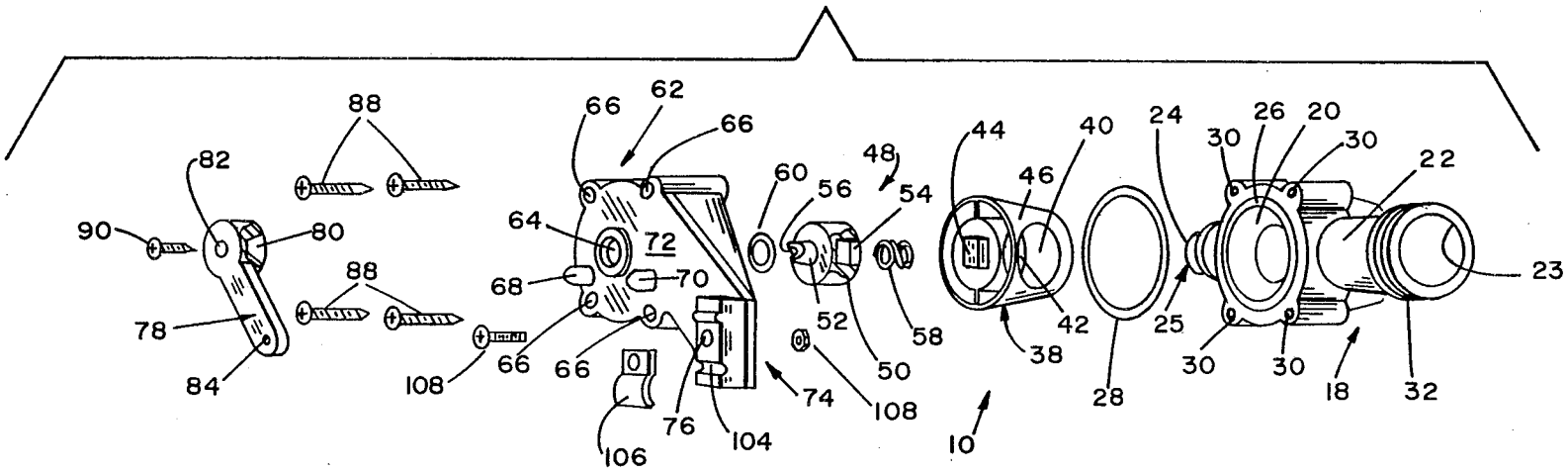
FIG. 3 is an exploded view of the valve used in the valve control system of the present invention.

Referring now to FIGS. 1 and 4 of the drawings, valve 10 is fixed in the back wall (transom) 12 of a hull 14 of a boat 15 and positioned on the inside 16 of boat 115. As seen in FIGS. 3 and 4, the valve 10 has a main housing 18 which includes a tapered, vertical, bore 20 opened at its large end and closed at its small end, a first longitudinal tube 22 in communication with the tapered bore 20, a second tube 24 diagonally opposed to the first longitudinal tube 22 in communication with the tapered bore 20, a circular groove 26 in the upper surface of the main housing 18 for receiving an O-ring 28 for sealing purposes, and a plurality of threaded openings 30 in the outer edges of the main housing 18. The first longitudinal tube 22 has a threaded end 32 for receiving a threaded nut 34. The boat is sealed at the threaded end 32 of first longitudinal tube 22 by an O-ring 33 fixed between the back wall 12 of the boat hull 14 and the threaded cap 34, and on the inside, by a ring seal 35. A rotatable valve element 38 having interconnected side wall opening 40 and 42 and a square nut member 44. The sidewalls 46 of the rotatable valve element 38 slope downwardly and inwardly, conforming to the walls of the tapered vertical bore 20 in the main housing 18. A rotatable wrench member 48 having a large cylindrical section 50, a small cylindrical section 52 tapered at its free end, a square opening 54 in large cylindrical section 50 conforming to the square nut member 44 on rotatable valve element 38, and internal threads 56 in the end of small cylindrical section 52. A spring 58 is provided for fitting within the square opening 54 of rotatable wrench member 48 to engage the inside bottom wall of the large cylindrical section 50 of rotatable wrench member 48 and the upper surface of the square nut member 44 of rotatable valve element 38, when the valve is completely assembled, to continously urge the tapered sidewalls 46 of rotatable valve element 38 against the conforming tapered bore 20 in the main housing 18. An O-ring 60 is provided to fit over the small cylindrical section 52 of rotatable wrench member 48 for engaging the inside wall of cover 62 for sealing purpose when the valve is completely assembled. Cover 62, as best shown in FIG. 3, includes a circular opening 64 of a diameter slightly larger than the diameter of the small cylindrical section 52 of rotatable wrench member 48, a plurality of openings 66 in its outer edges spaced so that they will be in alignment with the threaded openings 30 in the main housing 18, stop members 68 and 70 extending from its upper external surface 72, and a shoulder 74 having an opening 76 therethrough. A handle 78 having a tapered internal bore 80 slightly larger than the tapered free end of small cylindrical section 52 of rotatable wrench member 48, a small opening 82 concentric to the threaded opening 56 in the end of the small cylindrical section 52 of the rotatable wrench member 48, and an opening 84 adjacent its outer edge for receiving a cable 85 which remotely operates the valve. The valve is held together through screws 88 which are inserted through the openings 66 in the outer edges of cover 62 for engagement with the threaded openings 30 in the outer edges of main housing 18. The handle 78 is attached to rotatable wrench member 48 by a screw 90 inserted in small opening 82 of handle 78 for engagement with the threaded opening 56 in the tapered end of the small cylindrical section 52 of rotatable wrench member 48.

Cable 85, housed in conduit 86, may be attached at one of its ends 98 (FIG. 1) to a cable control station 100 which may be mounted adjacent the main boat control system 102, if desired. Of course, cable control station 100 may be mounted in any of many different locations in the boat, such as on the inside of back wall (transom) 12 (FIG.2). The other end 104 of cable 85 and conduit 86 extends through a slot 104 in shoulder 74 of cover 62 and conduit 86 is secured to the shoulder 74 by a clip 106 which is in turn secured to shoulder 74 by a screw 108, with the end if cable 85 being secured within opening 84 of handle 78. The position of the lever or knob (see solid and dash lines in FIG. 2) at cable control station 100 provides an indication to the operator as to whether the valve is opened or closed at that time. Indicia might also be placed adjacent to the lever or knob at cable control station 100 to alert the operator as to whether the valve is opened or closed.

As is readily apparent, when the valve control system of the present invention is mounted in the interior of the boat and is used solely for bailing water from the boat, the longitudinal tube 24 may be removed, leaving only a port or opening in the main housing 18 in communication with the tapered bore 20 of main housing 18 and the interior of the boat.

As is also readily apparent, the valve shown in FIGS. 1 and 4 is adaptable to be used to maintain fresh water in the live well 92 (FIG. 2) of boat 15 by having longitudinal tube 24 in communication with the interior of the live well 92 of the boat 15 through use of a hose or other tubing or by having tube 24 in direct communication with live well 92. Of course, it would be impracticable to use the conventional drain tube of a boat for mounting the valve when the valve is in communication with the live well of the boat, so the valve should normally be mounted on the back wall of the boat hull at least a small distance from the conventional drain tube.

Referring now to FIG. 2 of the drawing, the valve 10 is mounted outside of the boat 15 and is fixed to a hose 94 connected to conduit 96 mounted in an opening in the back wall 12 of the boat hull 14. The conduit 96, as shown, when in communication with the interior of live well 92, either directly or through a hose or other tubing, is normally in addition to the conventional drain tube of a boat. The means for mounting conduit 96 to the back wall 12 of boat hull 14 can be by any conventional means including that generally described with respect to FIGS. 1 and 4.

As is readily apparent, the valve, as shown mounted in FIG. 2, is readily adaptable to be used to bail or drain water from the interior of a boat by mounting the valve outside the boat on an extension to the conventional drain tube of the boat. When so mounted the valve would normally be closed except when the operator desired to bail or drain water from the boat.

As is further readily apparent, when the valve control system of the present invention is mounted in the interior of the boat and used solely for bailing water from the boat, the longitudinal tube 24 may be eliminated, leaving only a port or opening in main housing 18 in communication with tapered bore 20 of main housing 18.

While the above description constitutes preferred embodiments of the present invention, it will be appreciated that the invention is susceptible to modification, variation and change without departing from the proper scope and fair meaning of the accompanying claims.

I claim:

1. A remote operated water control system for a boat comprising:

a. a valve including a main housing having a central bore therein and a rotatable valve element having a passageway therethrough mounted in said central bore, said main housing including a pair of opposed aligned ports, each of said ports extending through said main housing in communication with said central bore, a first of said pair of ports communicating with an interior water retaining portion of said boat, the second of said pair of ports communicating externally of said boat, closure means affixed to an external surface of said main housing and secured to said valve element for rotation of said valve element within said central bore of said main housing whereby said passageway of said valve element may be moved in and out of registry with said opposed ports;

b. cable means having first and second ends, said first end conneted to said closure means; and c. actuating means connected to said second end of said cable means for displacement thereof to effect movement of said closure means and, thus, the rotation of said valve element, said actuating means including means for indicating when said passageway of said valve element is in or out of registry with said opposed ports.

2. The remote operated water control system of claim 1 wherein said valve is mounted inside of said boat and said second of said pair of ports includes a tube extending through and affixed to a back wall of said boat, and said interior water retaining portion of said boat comprises a live well for housing fish and keeping them alive for extended periods of time.

3. The remote operated water control system of claim 2 wherein said central bore of said main housing has tapered sidewalls, and said valve element includes tapered sidewalls conforming engagement with said tapered sidewalls of said central bore of said main housing.

4. The remote operated water control system of claim 3 wherein said closure means includes stop member for limiting the rotational movement of said valve element between a first position where said passageway is in registry with said opposed ports and a second position where said passageway is out of registry with said opposed ports.

5. The remote operated water control system of claim 4 wherein said closure means further includes a handle and a wrench member in engagement with said valve element for effecting movement of said valve element between said first and second positions.

6. The remote operated water control system of claim 1 wherein said valve is mounted inside of said boat and said second of said pair of port include a tube extending through and affixed to a back wall of said boat, and said interior water retaining portion of said boat comprises the floor of said boat, and said water control system being used for bailing unwanted water from said floor of said boat.

7. The remote operated water control system of claim 6 wherein said central bore of said main housing has tapered sidewalls, and said valve element includes tapered sidewalls conforming to said tapered sidewalls of said valve element in constant engagement with said tapered sidewalls of said central bore of said main housing.

8. The remote operated water control system of claim 7 wherein said closure means include stop members for limiting the rotational movement of said valve element between a first position where said passageway is in registry with said opposed ports and a second position where said passageway is out of registry with said opposed ports.

9. The remote operated water control system of claim 8 wherein said closure means further include a handle and a wrench member in engagement with said valve element for effecting movement of said valve element between said first and second positions.

10. The remote operated water control system of claim 1 wherein said boat includes a back wall, a conduit fixed in and extending through said wall, said conduit having a first end extending beyond said back wall to the exterior of said boat below the water line when said boat is surrounded by water and a second end extending within said back wall into the interior of said boat, a hose secured to said first end of said conduit and to said first of said pair of ports of said main housing of said vlave for said communication of said interior water retaining portion of said boat with the exterior of said boat to permit the flow of water in or out of said interior water portion of said boat.

11. The remote operated water control system of claim 10 wherein said interior water retaining portion of said boat comprises a live well for housing fish and keeping them alive for extended periods of time.

12. The remote operated water control system of claim 11 wherein said central bore of said main housing has tapered sidewalls, and said valve element includes tapered sidewalls conforming to said tapered sidewalls of said valve element in constant engagement with said tapered sidewalls of said central bore of said main housing.

13. The remote operated water control system of claim 12 wherein said closure means include stop members for limiting the rotational movement of said valve element between a first position where said passageway is in registry with said opposed ports and a second position where said passageway is out of registry with said opposed ports.

14. The remote operated water control system of claim 13 wherein siad closure means further includes a handle and a wrench member in engagement with said valve element for effecting movement of said valve element between said first and second positions.

15. The remote operated water control system of claim 10 wherein said interior water retaining portion of said boat comprises the floor of said boat, and said water control system is used for bailing unwanted water from said floor of said boat.

16. The remote operated water control systen of claim 15 wherein said central bore of said main housing has tapered sidewalls, and said valve element includes tapered sidewalls conforming to said tapered sidewalls of said tapered bore, and means for urging said tapered sidewalls of said valve element in constant engagement with said tapered sidewalls of said central bore of said main housing.

17. The remote operated water control system of claim 16 wherein said closure means includes stop members for limiting the rotational movement of said valve element between a first position where said passageway is in registry with said opposed ports and a second position where said passageway is out of registry with said opposed ports.

18. The remote operated water control system of claim 17 wherein said closure means further includes a handle and a wrench member in engagement with said valve element for effecting movement of said valve element between said first and second positions.

19. The combination comprising a boat, a boat hull, a back wall in said boat hull, a conduit extending through and projecting from each side of said back wall, and interior water retaining area in said boat in cmmunication with said conduit, and a remote operated water control system, said remote operated water control system comprising:

a. a valve; and b. means for remotely actuating said valve for controlling the flow of water to and from said interior water retaining area of said boat;

c. said valve comprising:

(1) a main housing having a vertical bore opened at a first end and closed at a second end, first and second opposed aligned ports extending transversely through said housing and intersecting said vertical bore, a circular groove in the upper surface of said main housing, an O-ring positioned in said circular groove for sealing purposes, and a plurality of threaded openings in the outer edges of the upper surface of said main housing, said first opposed port of said main housing being connected to said conduit extending through said back wall of said hull of said boat;

(2) a rotatable valve element mounted in said vertical bore of said main housing, said rotatable valve element having a passageway therethrough, and a nut member fixed thereto on its upper surface;

(3) a rotatable wrench member including a large cylindrical section, a small cylindrical section, and an O-ring, said large cylindrical section having a recess in its lower end and a shoulder at its upper end where it joins said small cylindrical section, said recess having sidewalls of the same configuration as said nut member of said rotatable valve element, said small cylindrical section having a threaded opening in its upper end, said O-ring being mounted on said small cylindrical section for sealing purposes;

(4) a cover having a circular opening for receiving said small cylindrical section of said rotatable wrench member and having an internal diameter slightly larger than the exterior diameter of said small cylindrical section, a plurality of openings in its outer edges spaced to be in alignment with said threaded openings in said main housing, stop means on the upper external surface of said cover for restricting the rotation of said rotatable valve element, and a shoulder on the outer edge of said cover having an opening therethrough;

(5) a spring positioned within said recess of said rotatable wrench member for acting on said nut member of said rotatable valve element for urging said rotatable valve element toward said second closed end of said vertical bore of said main housing; and (6) a plurality of screws positioned within said openings in said cover and said threaded opening in said main housing for tightly securing and sealing said cover, said rotatable wrench member, and said rotatable valve element to said main housing;

(d) said means for remotely actuating said valve for controlling the flow of water to and from said interior water retaining area of said boat comprising:

(1) a handle having a first opening concentric with said threaded opening in said small cylindrical section of said rotatable wrench member, a second opening adjacent the outer edge of said handle, and a screw positioned within said first opening of said handle and said threaded opening in said small cylindrical section if said rotatable wrench member for securing said handle to said rotatable wrench member, said handle being of a size that it may engage said stop means on said upper surface of said cover to restrict the rotatation of said rotatable valve element;

(2) cable means having first and second ends, said first end connected to said handle at said second opening in said handle; and (3) actuating means connected to said second end of said cable means for displacement of said cable means to effect movement of said handle, said rotatable wrench member, and said rotatable valve element to cause said passageway of said rotatable valve element to move in and out of registry with said ports of said main housing, said actuating means including means for indicating when said passageway and said ports are in or our of registry.

* * * * *